US009256169B2

(12) United States Patent
Jung et al.

(10) Patent No.: US 9,256,169 B2
(45) Date of Patent: Feb. 9, 2016

(54) IMAGE FORMING APPARATUS AND METHOD OF INITIALIZING AND CLEANING A TRANSFER ROLLER THERIN

(71) Applicant: Samsung Electronics Co., Ltd., Suwon-si (KR)

(72) Inventors: Won Chul Jung, Suwon-si (KR); Byoung Chul Bae, Suwon-si (KR); Gun Ho Kim, Seoul (KR); Myung Ho Kyung, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/056,377

(22) Filed: Oct. 17, 2013

(65) Prior Publication Data

US 2014/0112670 A1 Apr. 24, 2014

(30) Foreign Application Priority Data

Oct. 19, 2012 (KR) ..... 10-2012-0116675

(51) Int. Cl.
*G03G 15/00* (2006.01)
*G03G 15/16* (2006.01)

(52) U.S. Cl.
CPC ..... *G03G 15/1685* (2013.01)

(58) Field of Classification Search
CPC ..... G03G 15/1675
USPC ..... 399/314
See application file for complete search history.

(56) References Cited

U.S. PATENT DOCUMENTS 5,689,771 A * 11/1997 Sato et al. ..... 399/101
5,870,650 A * 2/1999 Takahashi et al. ..... 399/98
2012/0057895 A1* 3/2012 Ottaviani ..... 399/92

FOREIGN PATENT DOCUMENTS

JP 2007-206475 8/2007
JP 2013011756 A * 1/2013

OTHER PUBLICATIONS

English machine translation of Japanese patent document Ikeda, Kiyohiro (JP2013011756A), "Image Forming Apparatus", by Ikeda, Kiyohiro; published Jan. 17, 2013.*

* cited by examiner

*Primary Examiner* — David Gray
*Assistant Examiner* — Geoffrey Evans
(74) *Attorney, Agent, or Firm* — Staas & Halsey LLP

(57) ABSTRACT

An image forming apparatus and a method of controlling the same is provided. A plurality of cells formed at the surface of a transfer roller is filled with a developing agent to initialize the transfer roller, thereby suppressing contamination and electrical non-uniformity of the transfer roller. A method of controlling an image forming apparatus includes determining whether a transfer roller mounted in the image forming apparatus is a new one and, upon determining that the transfer roller is a new one, feeding a developing agent to the surface of the transfer roller and filling a plurality of cells formed at the surface of the transfer roller with the developing agent to initialize the transfer roller.

18 Claims, 11 Drawing Sheets

IMAGE FORMING APPARATUS AND METHOD OF INITIALIZING AND CLEANING A TRANSFER ROLLER THERIN

CROSS-REFERENCE TO RELATED APPLICATIONS

This application claims the priority benefit of Korean Patent Application No. 10-2012-0116675, filed on Oct. 19, 2012 in the Korean Intellectual Property Office, the disclosure of which is incorporated herein by reference.

BACKGROUND

1. Field

Embodiments relate to an image forming apparatus including a transfer roller to charge paper such that a developing agent is adsorbed to the paper and a method of controlling the same.

2. Description of the Related Art

An electrophotographic type image forming apparatus uses a transfer member to feed a toner image generated by a developing member to recording media, i.e. paper. A corona mode and a transfer roller mode are known as transfer modes. The transfer roller mode is mainly used in consideration of miniaturization of image forming apparatuses and ozone generation in the corona mode.

In the transfer roller mode, transfer bias is applied to the transfer member, i.e. the transfer roller, to generate a transfer field and transfer is electrostatically performed according to the transfer field. In the transfer roller mode, however, paper may be contaminated by the transfer roller if the transfer roller contains contaminants before the paper contacts the transfer roller. For this reason, the transfer roller may be cleaned.

A first method of cleaning the transfer roller is to provide a cleaning member to clean the transfer roller. Specifically, a cleaning blade or a cleaning roller is disposed at the rear of the transfer roller to clean the transfer roller. However, this method needs additional devices and is thus not suitable for miniaturization and reduction of cost. Furthermore, the cleaning member may increase torque of the transfer roller and thus negatively affect jitter.

A second method of cleaning the transfer roller is an electrostatic cleaning method of applying transfer bias to the transfer roller to clean the transfer roller. After or before transfer of a toner image, cleaning bias is applied to the transfer roller to remove toner from the transfer roller. Specifically, cleaning bias having the same polarity as toner and cleaning bias having a polarity opposite to that of the toner are alternately applied to the transfer roller. As a result, toner charged with positive (+) and negative (−) polarities may be removed from the transfer roller.

When the transfer roller is cleaned in the transfer bias mode, uncharged paper powder or non-polar toner with an external additive removed therefrom is not removed. Furthermore, if the transfer roller is partially contaminated, the transfer roller is not uniformly charged with the result that image quality may be deteriorated and cleaning may not be completely achieved.

SUMMARY

In an aspect of one or more embodiments, there is provided an image forming apparatus and a method of controlling the same wherein a plurality of cells formed at the surface of a transfer roller is filled with a developing agent to initialize the transfer roller, thereby suppressing contamination and electrical non-uniformity of the transfer roller.

In an aspect of one or more embodiments, there is provided a method of controlling an image forming apparatus includes determining whether a transfer roller mounted in the image forming apparatus is a new one and, upon determining that the transfer roller is a new one, feeding a developing agent to a surface of the transfer roller and filling a plurality of cells formed at the surface of the transfer roller with the developing agent to initialize the transfer roller.

The method may further include determining that the transfer roller is a new one when a count value of use time of the transfer roller is reset.

The method may further include controlling a photoconductor such that the developing agent is fed to the surface of the transfer roller via the photoconductor.

An outer layer of the transfer roller may be formed of a foam material.

The method may further include cleaning the initialized transfer roller without additional application of the developing agent.

In an aspect of one or more embodiments, there is provided a method of controlling an image forming apparatus includes determining whether a transfer roller initialization command has been generated and, upon determining that the transfer roller initialization command has been generated, feeding a developing agent to a surface of the transfer roller and filling a plurality of cells formed at the surface of the transfer roller with the developing agent to initialize the transfer roller.

The transfer roller initialization command may be generated by user input.

An outer layer of the transfer roller may be formed of a foam material.

The method may further include cleaning the initialized transfer roller without additional application of the developing agent.

In an aspect of one or more embodiments, there is provided an image forming apparatus includes a transfer roller and a controller to control the transfer roller such that a developing agent is fed to a surface of the transfer roller and a plurality of cells formed at the surface of the transfer roller is filled with the developing agent to initialize the transfer roller upon determining that the transfer roller is a new one.

The image forming apparatus may further include a counter to count use time of the transfer roller, wherein the controller may determine that the transfer roller is a new one when a count value of the counter is reset.

The controller may control a photoconductor such that the developing agent is fed to the surface of the transfer roller via the photoconductor.

An outer layer of the transfer roller may be formed of a foam material.

The controller may control the initialized transfer roller to be cleaned without additional application of the developing agent.

In accordance with an aspect of one or more embodiments, there is provided an image forming apparatus includes a transfer roller and a controller to control the transfer roller such that a developing agent is fed to a surface of the transfer roller and a plurality of cells formed at the surface of the transfer roller is filled with the developing agent to initialize the transfer roller upon determining that a transfer roller initialization command has been generated.

The transfer roller initialization command may be generated by user input.

An outer layer of the transfer roller may be formed of a foam material.

The controller may control the initialized transfer roller to be cleaned without additional application of the developing agent.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
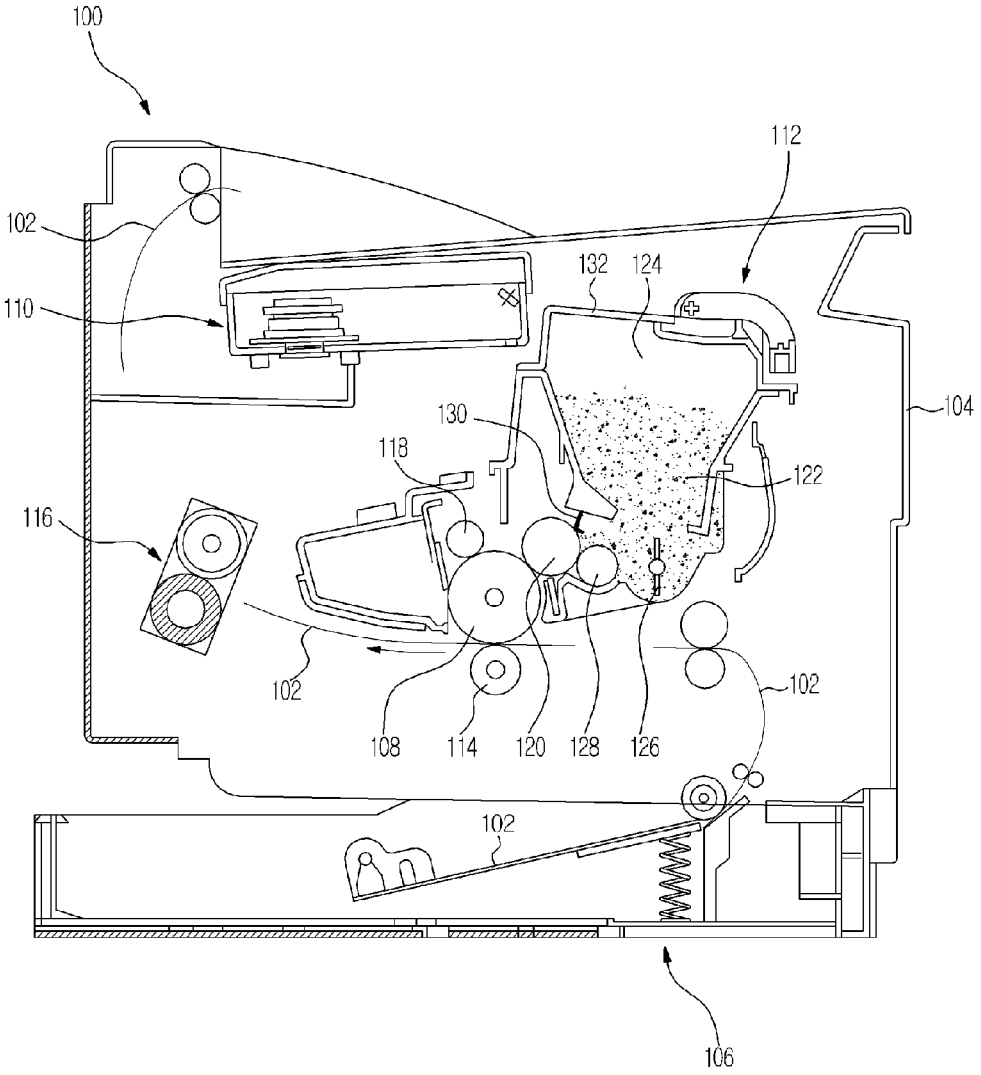
FIG. 1 is a view showing an image forming apparatus according to an embodiment.

Reference will now be made in detail to embodiments, examples of which are illustrated in the accompanying drawings, wherein like reference numerals refer to like elements throughout.

FIG. 1 is a view showing an image forming apparatus 100 according to an embodiment. In particular, the image forming apparatus 100 of FIG. 1 is an electrophotographic type monochromatic image forming apparatus to form only a monochromatic image. As shown in FIG. 1, the image forming apparatus 100 includes a body case 104, a paper supply unit 106, a photoconductor 108, a light scanning unit 110, a developing cartridge 112, a transfer roller 114, and a fusing unit 116.

The body case 104 forms the external appearance of the image forming apparatus 100. The paper supply unit 106 is provided in the body case 104. Paper 102 is loaded in the paper supply unit 106.

The photoconductor 108 is formed in the shape of a cylindrical drum extending a predetermined length corresponding to the width of paper 102. The photoconductor 108 is charged with fixed polar potential by a charging roller 118, which will hereinafter be described. An electrostatic latent image due to potential difference is formed on the photoconductor 108, the outer circumference of which is uniformly charged, by beams scanned by the light scanning unit 110. Toner 122 is supplied to the electrostatic latent image by a developing roller 120, which will hereinafter be described. An image due to the toner 122 is transferred to paper 102 passing through a space between the photoconductor 108 and the transfer roller 114.

The light scanning unit 110 scans beams corresponding to image data to be formed on paper 102 to the photoconductor 108 such that an electrostatic latent image is formed on the photoconductor 108. The light scanning unit 110 may include a laser scanning unit using a laser diode as a light source. Various other light sources may replace the laser scanning unit.

The developing cartridge 112 supplies a developing agent, i.e. toner 122, to the electrostatic latent image of the photoconductor 108. The developing cartridge 112 includes a cartridge case 132, a charging roller 118, a developing roller 120, a toner storage unit 124, a hopper 126, a supply roller 128, and a regulation blade 130. The charging roller 118 and the photoconductor 108 are rotated in contact. The charging roller 118 charges the surface of the photoconductor 108 with a predetermined potential value. The developing roller 120 supplies toner 122 to the electrostatic latent image formed on the photoconductor 108. The toner storage unit 124 is provided in the cartridge case 132 to store toner 122. The hopper 126 is provided in the toner storage unit 124. The supply roller 128 is provided in the toner storage unit 124 to supply toner 122 to the developing roller 120. The regulation blade 130 extends from the toner storage unit 124 so as to contact the developing roller 120. The charging roller 118 is provided in the cartridge case 132 to be rotated in contact with the photoconductor 108. The charging roller 118, to which charging bias has been applied, charges the outer circumference of the photoconductor 108 with a predetermined potential value. When beams from the light scanning unit 110 are scanned to the photoconductor 108 charged with the predetermined potential value by the charging roller 118, potential values of points of the photoconductor 108 to which the beams have been scanned are changed due to optical conduction characteristics of the photoconductor 108. As a result, potential difference occurs between the points of the photoconductor 108 to which the beams have been scanned and points of the photoconductor 108 to which the beams have not been scanned. Consequently, an electrostatic latent image due to potential difference is formed on the photoconductor 108. The developing roller 120 is mounted adjacent to the toner storage unit 124 and is rotated in the direction opposite to the rotational direction of the photoconductor 108. The developing roller 120, to which developing bias has been applied, is rotated in contact with the supply roller 128. The toner 122 from the supply roller 128 is attached to the developing roller 120 due to potential difference between the developing roller 120 and the supply roller 128. The developing roller 120, to which the toner 122 has been attached, is rotated in contact with the photoconductor 108. As a result, the toner 122 is supplied to the electrostatic latent image of the photoconductor 108. The toner storage unit 124 is formed in the cartridge case 132 as a space to store toner 122. The toner storage unit 124 is opened at one side thereof at which the developing roller 120 is provided. Consequently, stored toner 122 is supplied to the developing roller 120 by the supply roller 128. At least one hopper 126 is mounted in the toner storage unit 124. The hopper 126 is rotated in the toner storage unit 124 to transfer toner 122 to the supply roller 128. Also, the hopper 126 agitates the toner 122 to prevent solidification of the toner 122 and improve mobility of the toner 122. In addition, the hopper 126 agitates the toner 122 such that the toner 122 is charged with a predetermined potential value. The supply roller 128 is provided at one side of the toner storage unit 124 so as to be rotated in contact with the developing roller 120. The supply roller 128 supplies the toner 122, transferred by the hopper 126, to the developing roller 120. The supply roller 128 is rotated in the direction opposite to the rotational direction of the developing roller 120. As a result, the toner 122 passing through a space between the supply roller 128 and the developing roller 120 is charged with a predetermined potential value. At the same time, a proper amount of toner 122 is attached to the developing roller 120. The regulation blade 130 extends from one end of the cartridge case 132 to contact the developing roller 120 at predetermined pressing force. As a result, the regulation blade 130 secures uniformity in amount of toner 122 supplied from the supply roller 128 and attached to the developing roller 120, i.e. mass of toner 122 per unit area of the developing roller 120 M/A (g/cm$^2$). Also, the regulation blade 130 charges the toner 122 attached to the developing roller 120 with a predetermined potential value. To this end, the regulation blade 130 may be configured to include a conductive material and to have a predetermined potential value upon receiving power.

Based on developing type of the image forming apparatus 100, toner 122 may be classified as two component type toner, one magnetic component type toner, or one nonmagnetic component type toner. In this embodiment, one nonmagnetic component type toner 122 is used. The one nonmagnetic component type toner 122 contains resin to adjust basic quantity of charge or to decide fusing temperature. The resin occupies 90% or more of the contents of the toner 122. Carbon to decide polarity and color, an external additive, such as wax, to improve mobility, and silica to improve hydrophobicity and mobility are added as other constituents. The toner 122 exhibits mobility in a dry state due to the constituents. In addition, the toner 122 is charged with a predetermined potential value due to friction.

The supply roller 128, the developing roller 120, the regulation blade 130, the charging roller 118, the photoconductor 108, and the transfer roller 114 are biased such that voltage difference occurs therebetween. The supply roller 128, the developing roller, 120, the regulation blade 130, the charging roller 118, the photoconductor 108, and the transfer roller 114 may be independently biased. Alternatively, a Zener diode may be individually provided for the supply roller 128, the developing roller 120, the regulation blade 130, the charging roller 118, the photoconductor 108, and the transfer roller 114 such that uniform voltage difference is maintained therebetween. Also, a variable control (for example, PWM control) type voltage supply device may be individually provided for the supply roller 128, the developing roller 120, the regulation blade 130, the charging roller 118, the photoconductor 108, and the transfer roller 114 to variably control the amplitudes of voltages applied to the supply roller 128, the developing roller, 120, the regulation blade 130, the charging roller 118, the photoconductor 108, and the transfer roller 114 using the surroundings and lifespan information of the image forming apparatus 100. The amplitudes of voltages applied to the supply roller 128, the developing roller 120, the regulation blade 130, the charging roller 118, the photoconductor 108, and the transfer roller 114 are variably controlled to properly adjust the concentration of toner. Proper adjustment in concentration of toner is directly related to quality of an image formed on paper. Only when proper concentration of toner is maintained at the entire image forming area of the paper, high-quality image may be obtained. To this end, the amplitudes of voltages applied to the supply roller 128, the developing roller 120, the regulation blade 130, the charging roller 118, the photoconductor 108, and the transfer roller 114 are variably controlled.

Figure 2:
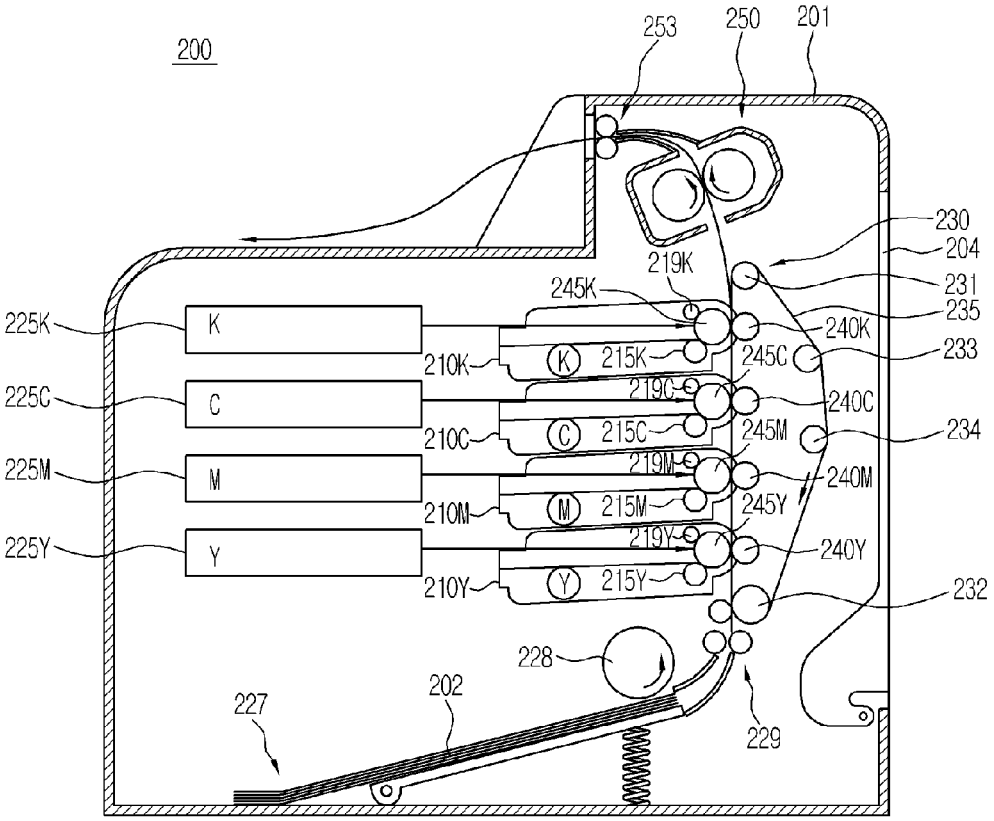
FIG. 2 is a view showing an image forming apparatus according to an embodiment.

FIG. 2 is a view showing an image forming apparatus 200 according to an embodiment. In particular, the image forming apparatus 200 of FIG. 2 is an electrophotographic type color image forming apparatus to form a color image.

As shown in FIG. 2, the image forming apparatus 200 includes four developing cartridges 210Y, 210M, 210C, and 210K, four light scanning units 225Y, 225M, 225C, and 225K, an image transfer unit 230, and a fusing unit 250, all of which are provided in a body case 201. Also, the image forming apparatus 200 further includes a paper supply unit 227, in which paper 202 is loaded, a pickup roller 228 to pick up the paper 202 from the paper supply unit 227 one by one, a feeding roller 229 to feed the picked up paper 202, and a paper discharge roller 253 to the paper 202, on which an image has been printed, from the body case 201.

When a developing agent, i.e. toner, is consumed, the developing cartridges 210Y, 210M, 210C, and 210K are replaced with new ones. In this embodiment, the developing cartridges 210Y, 210M, 210C, and 210K contains different color toners, such as yellow (Y), magenta (M), cyan (C), and black (K) toners, respectively, to print a color image. When a door 204 provided at one side of the body case 201 is opened, a transfer belt 235 is disposed horizontally such that the used developing cartridges 210Y, 210M, 210C, and 210K may be replaced with new ones.

In this embodiment, the four light scanning units 225Y, 225M, 225C, and 225K correspond to the developing cartridges 210Y, 210M, 210C, and 210K, respectively. The light scanning units 225Y, 225M, 225C, and 225K scan yellow (Y), magenta (M), cyan (C), and black (K) lights corresponding to image information to photoconductors 245Y, 245M, 245C, and 245K mounted in the respective developing cartridges 210Y, 210M, 210C, and 210K. A laser scanning unit (LSU) using a laser diode as a light source may be adopted for each of the light scanning units 225Y, 225M, 225C, and 225K.

The photoconductors 245Y, 245M, 245C, and 245K and developing rollers 215Y, 215M, 215C, and 215K are provided in the developing cartridges 210Y, 210M, 210C, and 210K, respectively. A portion of the outer circumference of each of the photoconductors 245Y, 245M, 245C, and 245K contacts the transfer belt 235 to transfer a toner image. Also, the developing cartridges 210Y, 210M, 210C, and 210K include charging rollers 219Y, 219M, 219C, and 219K, respectively. Charging bias is applied to the charging rollers 219Y, 219M, 219C, and 219K to charge the outer circumferences of the photoconductors 245Y, 245M, 245C, and 245K with uniform potential.

The developing rollers 215Y, 215M, 215C, and 215K supply toner, attached to the outer circumferences thereof, to the photoconductors 245Y, 245M, 245C, and 245K, respectively. Developing bias is applied to the developing rollers 215Y, 215M, 215C, and 215K to supply toner to the photoconductors 245Y, 245M, 245C, and 245K. Also, although not shown, supply rollers (not shown) to supply toner to the developing rollers 215Y, 215M, 215C, and 215K, regulation blades to regulate the amount of toner attached to the developing rollers 215Y, 215M, 215C, and 215K, and agitators to feed toner to the supply roller (not shown) while agitating the toner are further provided in the developing cartridges 210Y, 210M, 210C, and 210K, respectively.

The image transfer unit 230 includes the four photoconductors 245Y, 245M, 245C, and 245K. In addition, the image transfer unit 230 further includes a driving roller, i.e. a first roller 231, a driven roller, i.e. a second roller 232, disposed under the first roller 231 in parallel, a transfer belt 235 to move in circulation while being wound on the first roller 231 and the second roller 232, and four transfer rollers 240Y, 240M, 240C, and 240K disposed between the first roller 231 and the second roller 232. Also, the image transfer unit 230 further includes auxiliary support rollers 233 and 234 to auxiliarily support the transfer belt 235. The four transfer rollers 240Y, 240M, 240C, and 240K are disposed opposite to the four photoconductors 245Y, 245M, 245C, and 245K while the transfer belt 235 is disposed between the transfer rollers 240Y, 240M, 240C, and 240K and the photoconductors 245Y, 245M, 245C, and 245K. The transfer rollers 240Y, 240M, 240C, and 240K charge the back side (a side opposite to a recording side on which an image is formed) of paper 202 passing through a space between the photoconductors 245Y, 245M, 245C, and 245K and the transfer rollers 240Y, 240M, 240C, and 240K with a polarity opposite to that of toner such that the toner from the surfaces of the photoconductors 245Y, 245M, 245C, and 245K is adsorbed to the front side of the paper 202. The fusing unit 250 fuses the toner on the front side of the paper 202. To this end, transfer bias is applied to the transfer rollers 240Y, 240M, 240C, and 240K.

Meanwhile, in the image forming apparatus 200, force to rotate the photoconductors 245Y, 245M, 245C, and 245K is greater than force to move the transfer belt 235. A drive gear (not shown) to transmit driving force is connected to each of the photoconductors 245Y, 245M, 245C, and 245K, and therefore, force to rotate the photoconductors 245Y, 245M, 245C, and 245K is large. On the other hand, the transfer belt 235 is moved only by the driving force of the first roller 231, and the other rollers 232, 233, 234, 240Y, 240M, 240C, and 240K are driven according to movement of the transfer belt 235, and therefore, force to move the transfer belt 235 is small.

Figure 3:
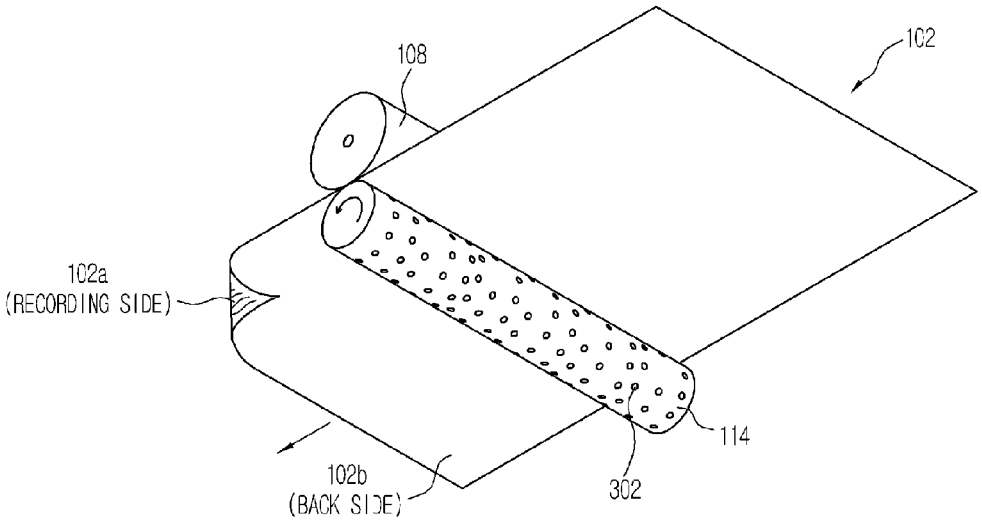
FIG. 3 is a view showing structures of a photoconductor and a transfer roller of the monochromatic image forming apparatus of FIG. 1.

FIG. 3 is a view showing structures of the photoconductor and the transfer roller of the monochromatic image forming apparatus of FIG. 1. As shown in FIG. 3, the transfer roller 114 of the image forming apparatus 100 is rotated in contact with the photoconductor 108 to transfer an image due to toner 122 to paper 102. That is, the transfer roller 114 charges the back side 102*b* (a side opposite to a recording side on which an image is formed) of paper 102 passing through the space between the photoconductor 108 and the transfer roller 114 with a polarity opposite to that of toner such that the toner 122 from the surface of the photoconductor 108 is adsorbed to the recording side 102*a* of the paper 102. To this end, transfer bias is applied to the transfer roller 114. The paper 102, to the recording side 102*a* of which the toner 122 has been adsorbed, passes through the fusing unit 116 of FIG. 1. At this time, the toner 102 is fused on the paper 102 by the fusing unit 116.

The transfer rollers 240Y, 240M, 240C, and 240K of the color image forming apparatus 200 shown in FIG. 2 are operated in the same manner as what was described above. However, the color image forming apparatus 200 includes the four transfer rollers 240Y, 240M, 240C, and 240K and photoconductors 245Y, 245M, 245C, and 245K corresponding to the number of colors of the developing agent, i.e. the toner, and a registration process for each color is carried out.

Referring back to FIG. 3, the outer layer of the transfer roller 114 is formed of a foam material, such as foam sponge. Consequently, a plurality of cells 302 is provided at the surface of the transfer roller 114. Contaminants, such as paper powder and waste toner (particularly, non-polar toner with an external additive removed therefrom), are introduced into the cells 302 to contaminate the back side 102*b* of the paper 102. Particularly if some cells 302 are filled with contaminants, some cells 302 are not filled with contaminants, and some cells 302 are partially filled with contaminants, transfer bias is not uniformly applied to the transfer roller 114 due to non-uniformity of the contaminants in the cells 302. Non-uniform application of bias to the transfer roller 114 may cause the paper 102 to be non-uniformly charged when the paper 102 is charged with a polarity opposite to that of the toner, and therefore, quality of an image may be deteriorated.

Figure 4:
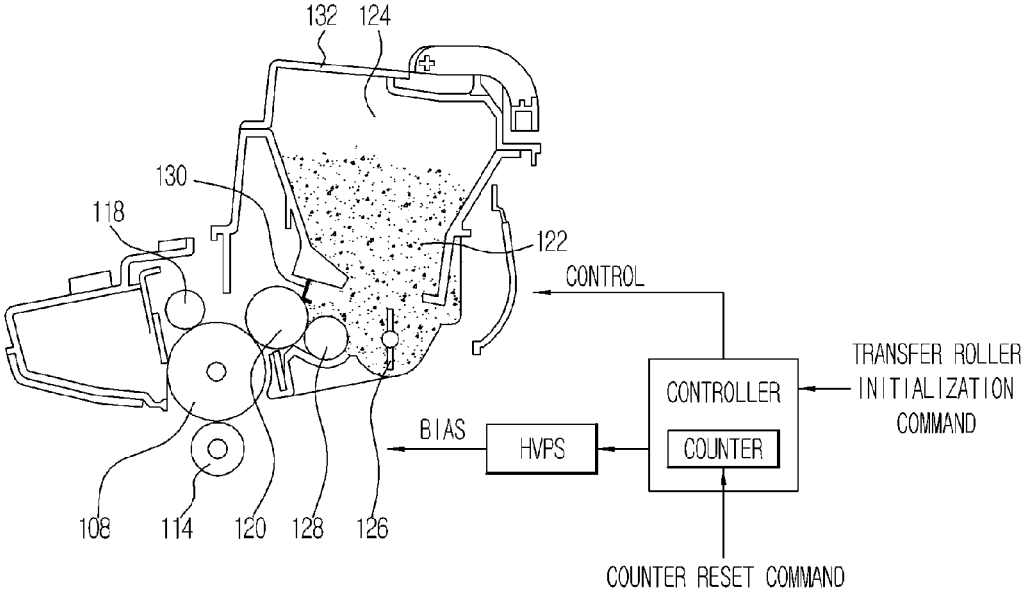
FIG. 4 is a view showing a control system of the image forming apparatus according to an embodiment.

FIG. 4 is a view showing a control system of the image forming apparatus according to an embodiment. The control system shown in FIG. 4 is applied to the monochromatic image forming apparatus 100 of FIG. 1. However, the control system shown in FIG. 4 may also be applied to the color image forming apparatus 200 of FIG. 2.

As shown in FIG. 4, a controller 402 controls overall operation of the image forming apparatus 100. The controller 402 has a counter 404 mounted therein. The counter 404 counts use time of the transfer roller 114. When a new transfer roller 114 is mounted, a user (or a service engineer) resets a count value of the counter 404. The counter 404 may be provided outside the controller 402. Also, the controller 402 may receive another user input. This user input may include a transfer roller initialization command generated through an input unit of the image forming apparatus 100 for a user (or a service engineer) to forcibly perform initialization of the transfer roller 114.

The controller 402 applies bias to the developing cartridge 112, the photoconductor 108, and the transfer roller 114 through a high voltage power supply 406 to perform electrical charge, development, and transfer. Also, the controller 402 controls the developing cartridge 112, the photoconductor 108, and the transfer roller 114 such that the transfer roller 114 is initialized to suppress contamination and electrical non-uniformity of the transfer roller 114. The electrical non-uniformity of the transfer roller 114 may include a case in which the transfer roller 114 has locally different surface resistance values. That is, the surface resistance of the region of the transfer roller 114 having cells 302 fully filled with contaminants or waste toner is relatively high, and the surface resistance of the region of the transfer roller 114 having cells 302 not filled with contaminants or waste toner or partially filled with contaminants or waste toner is relatively low. Initialization of the transfer roller 114 is to pre-fill the cells 302 formed at the outer surface of the transfer roller 114, the outer layer of which is formed of foam sponge, with a developing agent, i.e. toner. That is, toner 122 is supplied and attached to the entire surface of the photoconductor 108 and contact between the photoconductor 108 and the transfer roller 114 is performed without introduction of paper 102 between the photoconductor 108 and the transfer roller 114 such that the toner 122 is attached to the surface of the transfer roller 114. Also, this process is continuously performed for a predetermined time such that all of the cells 302 of the transfer roller 114 are uniformly filled with the toner 122. Through initialization, introduction of contaminants into the cells 302 of the transfer roller 114 may be suppressed and electrical non-uniformity of the transfer roller 114, which may occur when only some of the cells 302 are filled with contaminants, may be solved. Initialization of the transfer roller 114 may be performed with respect to the transfer roller 114 in use or a new transfer roller 114.

Figure 5A:
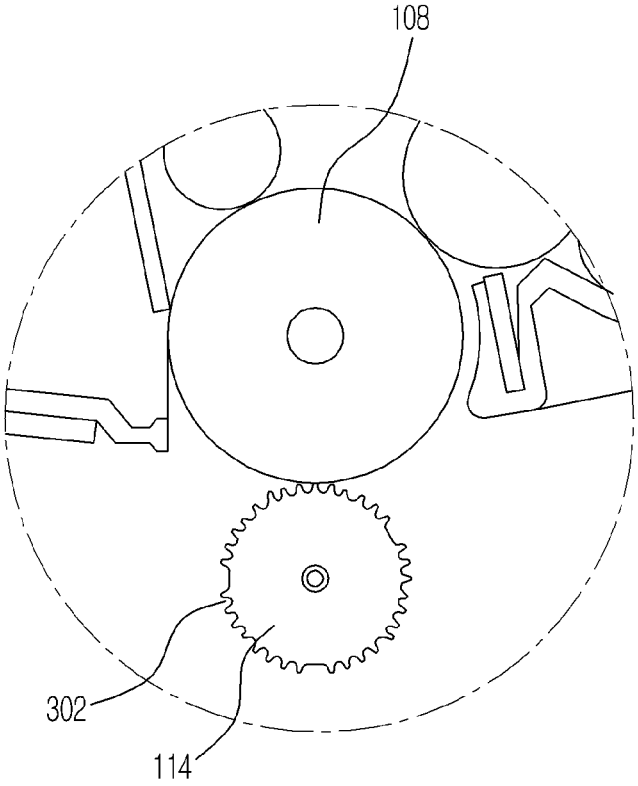
FIGS. 5A and 5B are views showing an initialization state of a transfer roller according to an embodiment.
Figure 5B:
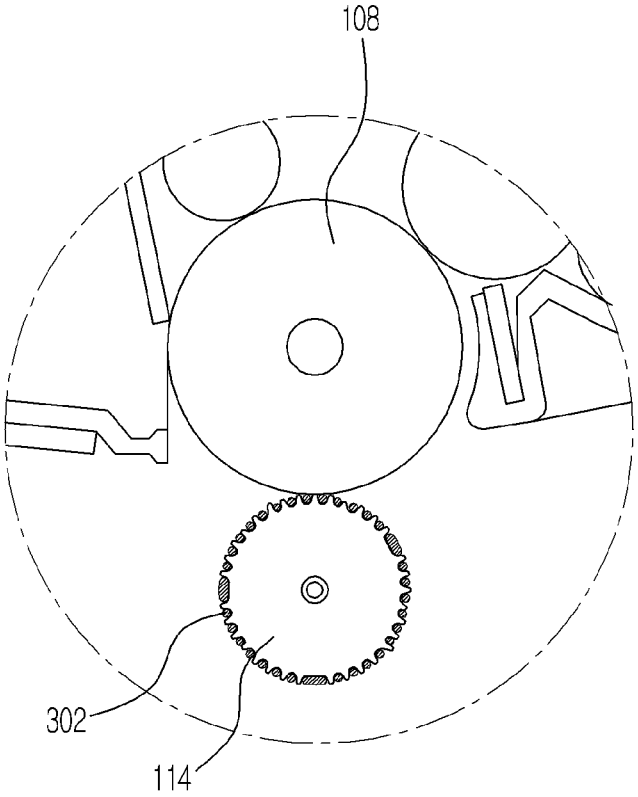

FIGS. 5A and 5B are views showing an initialization state of a transfer roller according to an embodiment. In particular, FIGS. 5A and 5B show an initialization state of a new transfer roller 114. A new transfer roller 114 is a transfer roller 114 which has not been used after production, such as a transfer roller 114 mounted in a new image forming apparatus 100 or a transfer roller 114 replacing a used transfer roller 114 of a sold image forming apparatus 100.

FIG. 5A is a view showing a state before a new transfer roller 114 is initialized. As shown in FIG. 5A, contaminants or waste toner is not present in a plurality of cells 302 formed at the surface of the transfer roller 114. If the transfer roller 114 is used as it is, contaminants or waste toner may be introduced into the cells 302. Through initialization of the transfer roller 114, therefore, the cells 302 are filled with toner.

FIG. 5B is a view showing a state after the transfer roller 114 is initialized. As shown in FIG. 5B, the cells 302 formed at the surface of the transfer roller 114 are filled with toner through initialization of the transfer roller 114. As all of the cells 302 of the transfer roller 114 are filled with toner, contaminants or waste toner is not introduced into the cells 302. Particularly, as the cells 302 are uniformly filled with toner, the transfer roller 114 may exhibit uniform electrical characteristics.

Figure 6A:
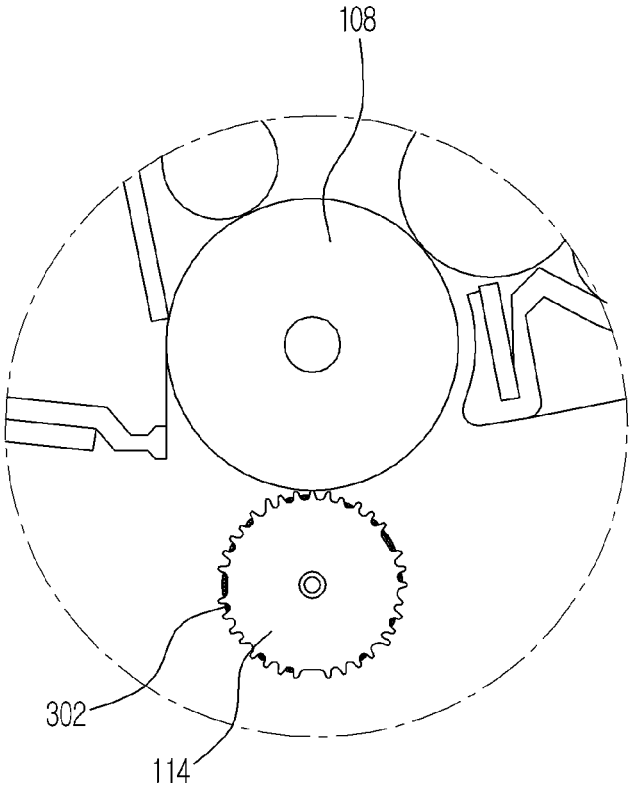
FIGS. 6A and 6B are views showing an initialization state of a transfer roller according to an embodiment.
Figure 6B:
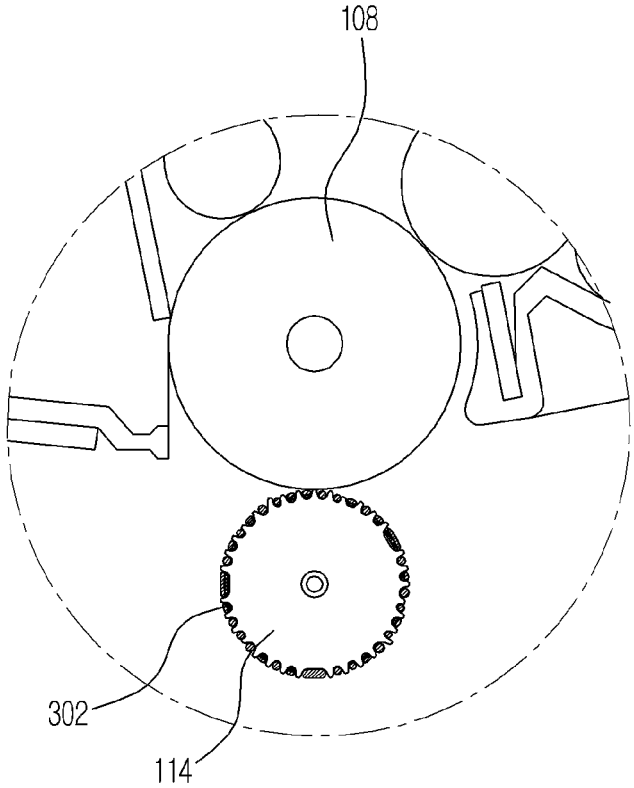

FIGS. 6A and 6B are views showing an initialization state of a transfer roller according to an embodiment. In particular, FIGS. 6A and 6B show an initialization state of a used transfer roller 114. A used transfer roller 114 is a transfer roller 114 which has already been mounted in the image forming apparatus 100.

FIG. 6A is a view showing a state before a used transfer roller 114 is initialized. As shown in FIG. 6A, contaminants or waste toner is present in some or all cells 302 formed at the surface of the transfer roller 114 through use of the image forming apparatus 100 before initialization. As a result, paper 102 or the photoconductor 108 may be contaminated by the contaminants in the cells 302 of the transfer roller 114. In addition, if some or all of the cells 302 are non-uniformly filled with the contaminants, electric characteristics of the transfer roller 114 may become non-uniform. Through initialization of the transfer roller 114, therefore, the cells 302 are filled with toner.

FIG. 6B is a view showing a state after the transfer roller 114 is initialized. As shown in FIG. 6B, the cells 302 formed at the surface of the transfer roller 114 are filled with toner through initialization of the transfer roller 114. As all of the cells 302 of the transfer roller 114 are filled with toner, contaminants or waste toner is not introduced into the cells 302. Particularly, as the cells 302 are uniformly filled with toner, the transfer roller 114 may exhibit uniform electrical characteristics.

Figure 7:
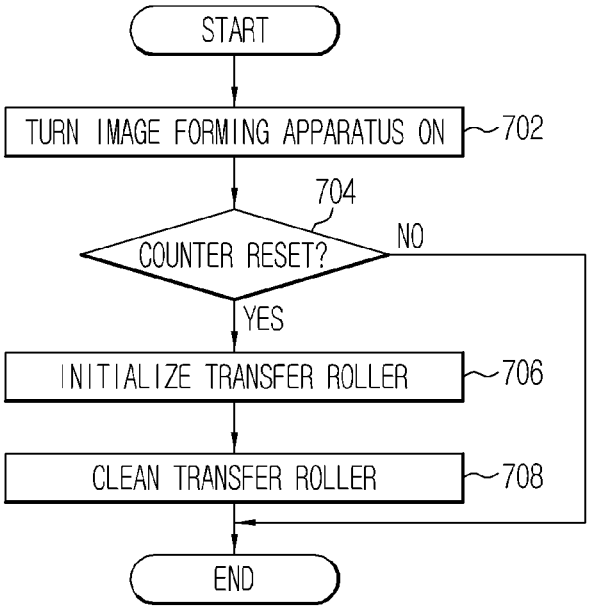
FIG. 7 is a view showing a method of controlling the image forming apparatus according to an embodiment.

FIG. 7 is a view showing a method of controlling the image forming apparatus according to an embodiment. The control method of FIG. 7 is used to initialize the new transfer roller 114 shown in FIGS. 5A and 5B.

As shown in FIG. 7, when the image forming apparatus 100 is turned on, power is supplied to the image forming apparatus 100 and the image forming apparatus 100 is ready to operate through warming-up (702). When a counter reset signal is input to the controller 402 in this state (YES of 704), the controller 402 resets a count value of the counter 404 in response to the counter reset signal. The counter reset signal is generated by a user (or a service engineer) through the input unit of the image forming apparatus 100. In a case in which the transfer roller 114 is replaced with a new one, the counter reset signal is generated to initialize a count value of a use period (or lifespan) of the transfer roller 114.

When the counter reset signal is generated, the controller 402 determines that the transfer roller 114 has been replaced with a new one, resets a count value of the counter 404, and controls the transfer roller 114 to be initialized (706). That is, in order to initialize the transfer roller 114, toner 122 is supplied and attached to the entire surface of the photoconductor 108 and contact between the photoconductor 108 and the transfer roller 114 is performed without introduction of paper 102 between the photoconductor 108 and the transfer roller 114 such that the toner 122 is attached to the surface of the transfer roller 114, under the control of the controller 402. Also, this process is continuously performed for a predetermined time such that all of the cells 302 of the transfer roller 114 are uniformly filled with the toner 122.

In addition, the controller 402 may perform cleaning with respect to the initialized transfer roller 114 (708). Cleaning may not be performed immediately after initialization of the transfer roller 114. That is, cleaning may be selectively performed as needed. Cleaning may be periodically performed after one initialization of the transfer roller 114. Alternatively, a predetermined number of cleaning operations may be performed after one initialization of the transfer roller 114, and the initialization and cleaning operations may be periodically repeated. Cleaning of the transfer roller 114 is a process of alternately applying positive (+) bias and negative (−) bias to the transfer roller 114 such that electric energy is supplied to the transfer roller 114 to remove contaminants or residual toner from the surface of the transfer roller 114. Cleaning of the transfer roller 114 may be performed using a symmetric application method of alternately applying positive (+) bias and negative (−) bias to the transfer roller 114 in the same period or an asymmetric application method of alternately applying positive (+) bias and negative (−) bias to the transfer roller 114 in different periods.

Figure 8:
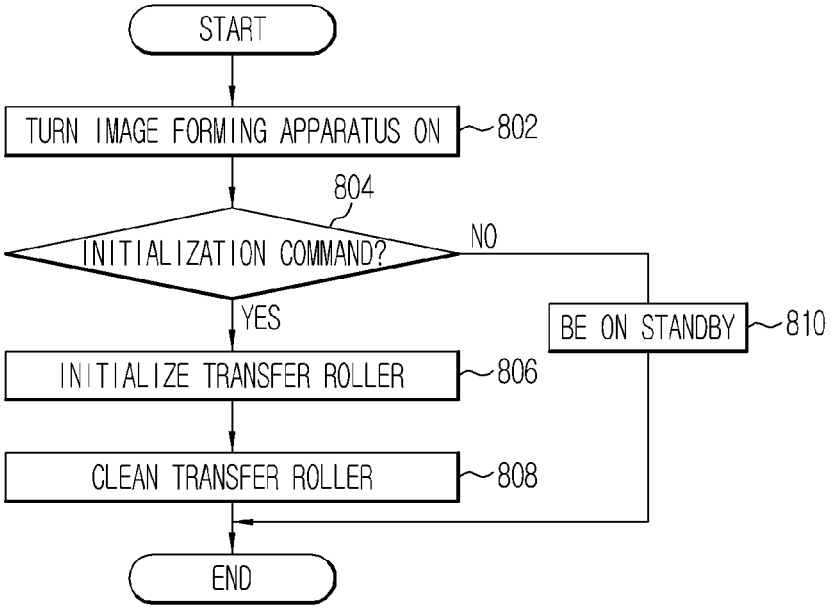
FIG. 8 is a view showing a method of controlling the image forming apparatus according to an embodiment.

FIG. 8 is a view showing a method of controlling the image forming apparatus according to an embodiment. The control method of FIG. 8 is used to initialize the used transfer roller 114 shown in FIGS. 6A and 6B.

As shown in FIG. 8, when the image forming apparatus 100 is turned on, power is supplied to the image forming apparatus 100 and the image forming apparatus 100 is ready to operate through warming-up (802). When an initialization command is input to the controller 402 in this state (YES of 804), the controller 402 controls the transfer roller 114 to be initialized in response to the initialization command (806). The initialization command is generated by a user (or a service engineer) through the input unit of the image forming apparatus 100 to forcibly initialize the transfer roller 114 even in a state in which the transfer roller 114 has not been replaced with a new one. Forcible initialization of the transfer roller 114 according to the initialization command may be performed in a case in which it is determined that initialization of the transfer roller 114 is necessary regardless of replacement of the transfer roller 114 or in a case in which it is determined that initialization of the transfer roller 114 is necessary in an image forming apparatus which is not configured to automatically initialize transfer roller 114 in response to reset of the counter 404. In order to initialize the transfer roller 114, toner 122 is supplied and attached to the entire surface of the photoconductor 108 and contact between the photoconductor 108 and the transfer roller 114 is performed without introduction of paper 102 between the photoconductor 108 and the transfer roller 114 such that the toner 122 is attached to the surface of the transfer roller 114, under the control of the controller 402. Also, this process is continuously performed for a predetermined time such that all of the cells 302 of the transfer roller 114 are uniformly filled with the toner 122.

In addition, the controller 402 may perform cleaning with respect to the initialized transfer roller 114 (808). Cleaning may not be performed immediately after initialization of the transfer roller 114. That is, cleaning may be selectively performed as needed. Cleaning may be periodically performed after one initialization of the transfer roller 114. Alternatively, a predetermined number of cleaning operations may be performed after one initialization of the transfer roller 114, and the initialization and cleaning operations may be periodically repeated. Cleaning of the transfer roller 114 is a process of alternately applying positive (+) bias and negative (−) bias to the transfer roller 114 such that electric energy is supplied to the transfer roller 114 to remove contaminants or residual toner from the surface of the transfer roller 114. Cleaning of the transfer roller 114 may be performed using a symmetric application method of alternately applying positive (+) bias and negative (−) bias to the transfer roller 114 in the same period or an asymmetric application method of alternately applying positive (+) bias and negative (−) bias to the transfer roller 114 in different periods.

When an initialization command is not input to the controller 402 in this state (NO of 804), then the controller 402 does not cause the transfer roller to be initialized (BE ON STANDBY 810).

Figure 9A:
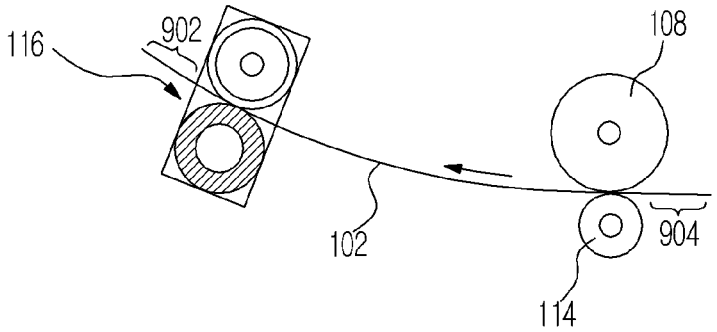
FIGS. 9A through 9D are views showing a method of checking a clean state of the transfer roller according to an embodiment after initialization state of the transfer roller.
Figure 9B:
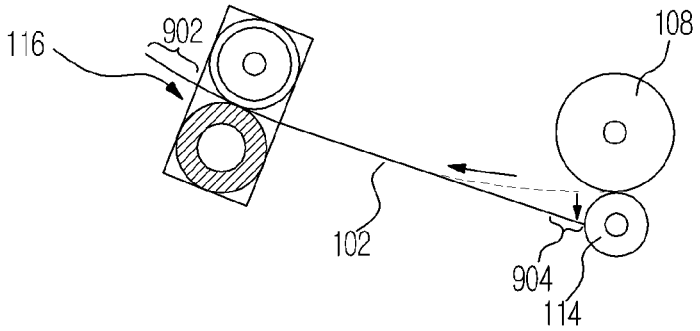

FIGS. 9A and 9B are views showing a method of checking a clean state of the transfer roller according to an embodiment after initialization of the transfer roller. FIG. 9A shows a state in which a front end 902 of paper 102 is inserted into the fusing unit 116 and a rear end 904 of the paper 102 has not yet passed through the space between the photoconductor 108 and the transfer roller 114. At this time, the paper 102 is advanced in a direction indicated by an arrow in a state in which the paper 102 is curled due to rotational speed difference between the fusing unit 116 and the transfer roller 114, thus having no tension.

As soon as the rear end 904 of the paper 102 escapes from the space between the photoconductor 108 and the transfer roller 114 as shown in FIG. 9B, the curled paper 102 is straightened, and therefore, the back side of the rear end 904 of the paper 102 sweeps the surface of the transfer roller 114. As a result, the back side of the rear end 904 of the paper 102 may be contaminated by the transfer roller 114.

Figure 9C:
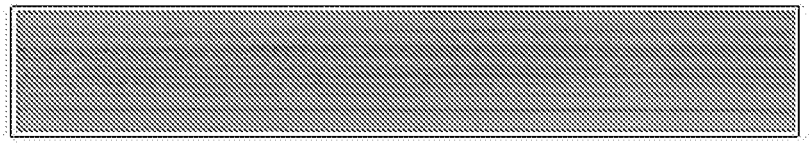
Figure 9D:
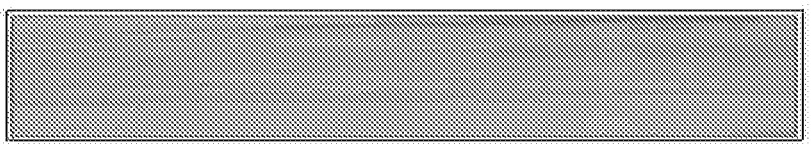

FIG. 9C shows a contamination state of the back side of the rear end 904 of the paper 102 before initialization of the transfer roller 114, and FIG. 9D shows a contamination state of the back side of the rear end 904 of the paper 102 after initialization of the transfer roller 114. As shown in FIGS. 9C and 9D, the back side of the rear end 904 of the paper 102 after initialization of the transfer roller 114 is less contaminated than the back side of the rear end 904 of the paper 102 before initialization of the transfer roller 114.

As is apparent from the above description, initialization of the transfer roller is performed to fill the cells formed at the surface of the transfer roller with toner, thereby suppressing contamination and electrical non-uniformity of the transfer roller and thus providing the following effects. First, the cells are prevented from being filled with contaminants through initialization to fill the cells formed at the surface of the transfer roller with toner. In addition, the transfer roller exhibits uniform electrical characteristics (for example, surface resistance) through initialization to fill the cells formed at the surface of the transfer roller with toner. During image formation, therefore, transfer bias may be uniformly applied to the transfer roller, and cleaning bias may be uniformly applied to the transfer roller, thereby improving a cleaning effect. Initialization of a new transfer roller provides higher effects. As needed, initialization may also be performed with respect to a transfer roller in use.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A method of controlling an image forming apparatus comprising:

determining whether a transfer roller mounted in the image forming apparatus is new; and upon determining that the transfer roller is new, transferring a developing agent to a surface of the transfer roller and filling a plurality of cells formed at the surface of the transfer roller with the developing agent to initialize the transfer roller.

2. The method according to claim 1, further comprising determining that the transfer roller is new when a count value of use time of the transfer roller is reset.

3. The method according to claim 1, further comprising controlling a photoconductor such that the developing agent is transferred to the surface of the transfer roller via the photoconductor.

4. The method according to claim 1, wherein an outer layer of the transfer roller is formed of a foam material.

5. The method according to claim 1, further comprising cleaning the initialized transfer roller without additional application of the developing agent.

6. A method of controlling an image forming apparatus comprising:

determining whether a transfer roller initialization command has been generated; and upon determining that the transfer roller initialization command has been generated, transferring a developing agent to a surface of the transfer roller and filling a plurality of cells formed at the surface of the transfer roller with the developing agent to initialize the transfer roller.

7. The method according to claim 6, wherein the transfer roller initialization command is generated by user input.

8. The method according to claim 6, wherein an outer layer of the transfer roller is formed of a foam material.

9. The method according to claim 6, further comprising cleaning the initialized transfer roller without additional application of the developing agent.

10. An image forming apparatus comprising:

a transfer roller; and a controller to control the transfer roller such that a developing agent is transferred to a surface of the transfer roller and a plurality of cells formed at the surface of the transfer roller is filled with the developing agent to initialize the transfer roller upon determining that the transfer roller is new.

11. The image forming apparatus according to claim 10, further comprising:

a counter to count use time of the transfer roller, wherein the controller determines that the transfer roller is new when a count value of the counter is reset.

12. The image forming apparatus according to claim 10, wherein the controller controls a photoconductor such that the developing agent is transferred to the surface of the transfer roller via the photoconductor.

13. The image forming apparatus according to claim 10, wherein an outer layer of the transfer roller is formed of a foam material.

14. The image forming apparatus according to claim 10, wherein the controller controls the initialized transfer roller to be cleaned without additional application of the developing agent.

15. An image forming apparatus comprising:

a transfer roller; and a controller to control the transfer roller such that a developing agent is transferred to a surface of the transfer roller and a plurality of cells formed at the surface of the transfer roller is filled with the developing agent to initialize the transfer roller upon determining that a transfer roller initialization command has been generated.

16. The image forming apparatus according to claim 15, wherein the transfer roller initialization command is generated by user input.

17. The image forming apparatus according to claim 15, wherein an outer layer of the transfer roller is formed of a foam material.

18. The image forming apparatus according to claim 15, wherein the controller controls the initialized transfer roller to be cleaned without additional application of the developing agent.

* * * * *